US009015976B2

(12) United States Patent
Moon

(10) Patent No.: US 9,015,976 B2
(45) Date of Patent: Apr. 28, 2015

(54) FRAME ASSEMBLY FOR DISPLAY PANEL

(71) Applicant: JSLCD Co., Ltd., Seoul (KR)

(72) Inventor: Jong Sub Moon, Seoul (KR)

(73) Assignee: JSLCD Co., Ltd. (KR)

( * ) Notice: Subject to any disclaimer, the term of this patent is extended or adjusted under 35 U.S.C. 154(b) by 0 days.

(21) Appl. No.: 14/151,123

(22) Filed: Jan. 9, 2014

(65) Prior Publication Data

US 2014/0208626 A1 Jul. 31, 2014

(30) Foreign Application Priority Data

Jan. 29, 2013 (KR) ..... 10-2013-0009694

(51) Int. Cl.

| | |
|---|---|
| ***G09F 15/00*** | (2006.01) |
| ***G09F 9/30*** | (2006.01) |
| ***G09F 13/18*** | (2006.01) |

(52) U.S. Cl.

CPC *G09F 9/30* (2013.01); *G09F 13/18* (2013.01); *G09F 15/0012* (2013.01); *G09F 2013/1881* (2013.01)

(58) Field of Classification Search

CPC ..... G09F 1/12; G09F 15/0018; A47G 1/0605; A47G 2001/0661; A47G 2001/0677; A47G 1/0611; A47G 1/10

USPC ..... 40/790–792, 782, 778

See application file for complete search history.

(56) References Cited

U.S. PATENT DOCUMENTS

| | | | | | |
|---|---|---|---|---|---|
| 4,216,597 | A * | 8/1980 | Kocina et al. | ..... | 40/792 |
| 4,349,974 | A * | 9/1982 | Rapayelian | ..... | 40/792 |
| 4,641,441 | A * | 2/1987 | Roth | ..... | 40/792 |
| 5,367,803 | A * | 11/1994 | Albin | ..... | 40/759 |
| 2014/0305015 | A1 * | 10/2014 | Zelbacher et al. | ..... | 40/714 |

FOREIGN PATENT DOCUMENTS

| | | |
|---|---|---|
| KR | 100751898 | 8/2007 |
| KR | 1020080084317 | 9/2008 |
| KR | 2020090004719 | 5/2009 |
| KR | 1020120129336 | 11/2012 |

* cited by examiner

*Primary Examiner* — Casandra Davis
(74) *Attorney, Agent, or Firm* — Cantor Colburn LLP

(57) ABSTRACT

A frame assembly includes a display panel, a rear cover, a housing and an assembling structure. The housing includes a plurality of frames which enclose the display panel and the rear cover. Each frame has a sidewall, and a connection member which connects the frames to each other. The assembling structure is installed in the housing to provide a closed structure and is provided to ensure coupling force among the display panel, the rear cover and the housing. The assembling structure includes a fastening bracket which presses the display panel onto the frames of the housing and fastens the display panel to the frames, a support bracket which supports the rear cover, and an auxiliary bracket which assists connection between the adjacent frames.

3 Claims, 4 Drawing Sheets

[4;30,40,50]

FRAME ASSEMBLY FOR DISPLAY PANEL

BACKGROUND OF THE INVENTION

1. Field of the Invention

The present invention relates generally to frame assemblies for display panels and, more particularly, to a frame assembly for installation of a display panel which is used for an electronic panel, a billboard, a monitor, etc. that is installed in a building, a vehicle or the like, the frame assembly having an assembling means for making the coupling force between the frames reliable, thus preventing the frame assembly from being damaged by external impact caused, for example, by vibration.

2. Description of the Related Art

Generally, conventional signboards, billboards, etc. include a housing which is provided with a transparent cover that is printed with advertisement contents, and a light source, such as a fluorescent lamp, an LCD, etc., which is installed in the housing.

A representative example of techniques that pertain to conventional signboards, billboards, etc. was proposed in Korean Patent Laid-open Publication No. 10-2008-0084317 (date: Sep. 9, 2008).

The conventional technique of No. 10-2008-0084317 relates to a frame structure for two-sided advertising signboard. The frame structure includes a middle frame in which a first insert space is formed above a main support part that has a hollow rectangular cross-sectional structure. A plurality of rectangular rods is inserted into the first insert space. The frame structure further includes a first elastic frame which is integrally provided under a lower end of the middle frame. A printed sheet which forms one surface of the two-sided advertising signboard is fixed to the first elastic frame. The frame structure further includes a second elastic frame which is coupled to an upper end of the middle frame by a hinge. A printed sheet which forms the other surface of the two-sided advertising signboard is fixed to the second elastic frame. The middle frame and the first elastic frame which form a framework of the two-sided advertising signboard are integrally manufactured by extruding. Therefore, the strength of the entire structure of the two-sided advertising signboard can be enhanced, and the assembly thereof can be facilitated. The printed sheets are inserted into the first and second elastic frames which are respectively coupled to the upper and lower ends of the middle frame. Therefore, the conventional frame structure having the above-mentioned construction can more reliably hold the printed sheets.

Another representative example of the conventional techniques was proposed in Korean Patent Laid-open Publication No. 10-2012-0129336 (date: Nov. 28, 2012).

The technique of No. 10-2012-0129336 relates to a signboard frame device. The signboard frame device includes a plurality of profiles each of which has a bar shape having a predetermined cross-section. The profiles are coupled to each other in a predetermined pattern, thus forming a frame of a signboard. The profiles include a bottom plate, side plates and a partition plate. Insert grooves into which a panel is inserted are formed between the side plates and the partition plate in a longitudinal direction. In such a signboard frame device using a light guide plate for advertisement, the light guide plate can be easily inserted into and installed in the insert grooves formed by the profiles having simple cross-sectional shapes. An LED bar which is used as a light source for the light guide plate is inserted into a lower space of the insert grooves which are partitioned by a partition piece. As such, this conventional signboard frame device is configured such that the LED bar can also be easily installed in the frame device.

A further representative example of the conventional techniques was proposed in Korean Utility Model Laid-open Publication No. 20-2009-0004719 (date: May 19, 2009).

This conventional technique relates to a body frame device for an LED advertising signboard. Particularly, the reflective plate and the light diffusion plate are placed on upper and lower surfaces of a light guide plate. A body frame which has short side plates is formed using aluminum material by extruding so that an advertising plate module in which an advertising phrase is printed on the surface of the light diffusion plate can be inserted into the body frame. Coupling parts that have a pair of guide parts protrude from upper ends of the side plates. The advertising plate module is inserted between the guide parts. A fixing part and a close contact surface which support an edge of the advertising plate module are formed in each coupling part. A reflective surface is provided on one end of the fixing part and the close contact surface at an inclined angle so that light of the LED is reflected by the reflective surface, is collected onto a central portion, and then is diffused to the advertising plate module. A through hole is formed in the coupling part. A mounting guider made of aluminum is inserted into the through hole in a sliding manner. An LED bar which is made of aluminum and on which a plurality of LEDs are arranged in a line is installed in the mounting guider. In this technique, the body frame which has the short side plates and is made of aluminum is formed by extruding, so that productivity can be enhanced and the body frame can be easily manufactured with a consistent shape. Furthermore, because the length of the side plate is short, the body frame can be installed in a confined space such as the interior of a subway or bus. Furthermore, because the LED bar which is made of aluminum and is provided with a plurality of LEDs is installed in the mounting guider made of aluminum, much heat generated from the LEDs is transferred to the body frame through the LED bar and the mounting guider before being dissipated to the outside through the body frame. Therefore, the LEDs can be prevented from being damaged by heat.

However, the above-mentioned conventional techniques are disadvantageous in that when a change in information (a company name or advertisement contents) to be delivered is required, a printed sheet or signboard must be re-manufactured.

In an effort to overcome the above problems inexpensive display panels such as LCDs (liquid crystal displays), LEDs (light emitting diodes), etc. have been introduced. Such electronic display boards which can easily change information to be delivered in an electronically controlled manner are widely used in lieu of billboards.

To install a billboard or the like using such a display panel for an electronic display board, a structure such as a frame is required for assembly of the display panel.

A representative example of such a frame structure was proposed in Korean Patent Registration No. 10-0751898 (date: Aug. 17, 2007).

This conventional technique relates to a frame structure for electronic devices. In detail, the frame structure includes an outer frame, and a main frame which is provided on a front surface of the outer frame and has a plate structure in which an LED board controlled by a control unit is installed on a front surface thereof. The main frame can be separated from the outer frame so that when the LED board malfunctions, it can be easily replaced with another one.

However, in the same manner as billboards installed in buildings, buses, etc., the LED board (display panel) is exposed to the outside, so that people easily come into contact with the LED board. Particularly, in the case of a billboard installed in a bus, there is a problem in that the display panel or the frame provided with the display panel may be easily damaged by impact caused by vibration when the bus is being operated.

SUMMARY OF THE INVENTION

Accordingly, the present invention has been made keeping in mind the above problems occurring in the prior art, and an object of the present invention is to provide a frame assembly for a display panel which includes an assembling means provided to secure reliable coupling among elements of the frame assembly, whereby a housing in which the display panel is installed is prevented from being reduced in the coupling force among the elements of the housing or being damaged by external factors such as vibration or impact.

Another object of the present invention is to provide a frame assembly for a display panel in which the display panel and a rear cover are enclosed by a housing that includes a frame and a connection member which have simple structures to ensure reliable coupling among the elements using the assembling means, make simple coupling assembly possible and reduce the assembly work time.

A further object of the present invention is to provide a frame assembly for a display panel which is configured such that the elements constituting the frame assembly can be systematically coupled to each other using a single fastening member, whereby not only the reliable coupling among the elements can be ensured but a worker can also more easily assemble even a large frame assembly.

Yet another object of the present invention is to provide a frame assembly for a display panel which has a tool insert hole and a tool insert notch so that despite the structure in which the assembling means for reliable coupling is provided inside the housing, the worker can easily conduct the assembly process, and a closed structure can be realized.

In order to accomplish the above object, the present invention provides a frame assembly for a display panel, including: a display panel; a rear cover; a housing having a plurality of frames enclosing the display panel and the rear cover, each of frames having a sidewall, and a connection member connecting the frames to each other; and assembling means installed in the housing to provide a closed structure, the assembling means provided to ensure coupling force among the display panel, the rear cover and the housing, wherein the assembling means includes: a fastening bracket pressing the display panel onto the frames of the housing and fastening the display panel to the frames; a support bracket supporting the rear cover; and an auxiliary bracket assisting connection between the adjacent frames.

Each of the frames may have: the sidewall; a mounting space formed by a support protrusion bent inwards from a lower end of the sidewall; a connection piece disposed above the mounting space, the connection piece comprising a connection part connected to the sidewall, a bent part bent downwards from the connection part, and a support part bent inwards from the bent part, the support bracket being coupled to the support part; and an insert slot formed between two bifurcating protrusions that are disposed above the connection piece and are bent inwards from an upper end of the sidewall, the rear cover being inserted into the insert slot in a sliding manner.

Furthermore, a tool insert hole may be formed in the sidewall of each of the frames so that a tool can be inserted into the housing through the tool insert hole to couple the auxiliary bracket of the assembling means to the bent part of the connection piece.

In addition, a tool insert notch may be formed at a predetermined position in the rear cover so that a tool can be inserted into the rear cover through the tool insert notch to couple the support bracket of the assembling means to the support part of the connection piece.

BRIEF DESCRIPTION OF THE DRAWINGS

The above and other objects, features and advantages of the present invention will be more clearly understood from the following detailed description taken in conjunction with the accompanying drawings, in which.

DESCRIPTION OF THE PREFERRED EMBODIMENTS

Figure 1A:
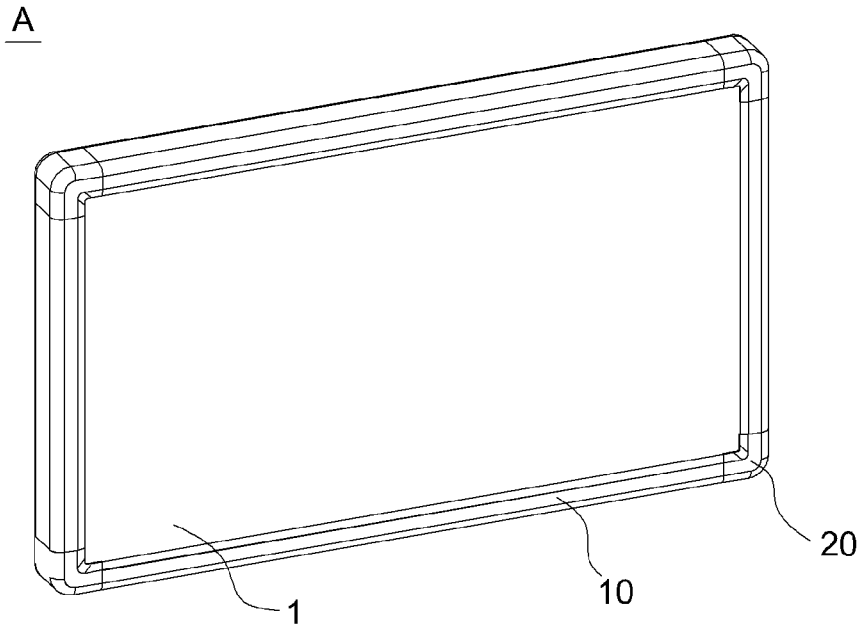
FIGS. 1A and 1B are perspective views illustrating a frame assembly for a display panel according to an embodiment of the present invention.

Hereinafter, the present invention will be described in detail with reference to the attached drawings.

This invention may, however, be embodied in many different forms, and should not be construed as limited to the embodiments set forth herein. Rather, all changes that fall within the bounds of the present invention, or the equivalence of the bounds are therefore intended to be embraced by the present invention.

The same reference numerals throughout the drawings, that is, the same reference numerals for the second digit or the first digit, or for the second digit, the first digit and a letter of the alphabet, denote elements having the same function. If not specifically mentioned otherwise, the elements denoted by the reference numerals are to be assumed to comply with the above-mentioned reference scheme.

In the drawings, the thicknesses of lines or the sizes of elements may be exaggerated or simplified to more clearly and conveniently illustrate the present invention, but the bounds of the present invention must not be interpreted as being limited thereto.

The terminology used herein is for the purpose of describing particular embodiments only and is not intended to be limiting. As used herein, the singular forms “a,” “an” and “the” are intended to include plural forms as well, unless the context clearly indicates otherwise. It will be further understood that the terms “comprises” and/or “comprising,” or “includes” and/or “including” when used in this specification, specify the presence of stated features, regions, integers, steps, operations, elements, and/or components, but do not preclude the presence or addition of one or more other features, regions, integers, steps, operations, elements, components, and/or groups thereof.

Unless otherwise defined, all terms including technical and scientific terms used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

The ordinal numerals "first", "second", "third", etc. are used only for the sake of description and they categorically do not impose a limit on the order of production. The terms used in the description of the embodiments may not coincide with those used in claims.

In the following description of a frame assembly for display panels according to an embodiment of the present invention, for the sake of description, approximate direction reference of up, down, left and right is defined based on FIGS. 1 and 2.

Unless otherwise defined in the description related to other drawings and claims, the present invention will be described based on the above-mentioned definition of the direction.

Figure 4:
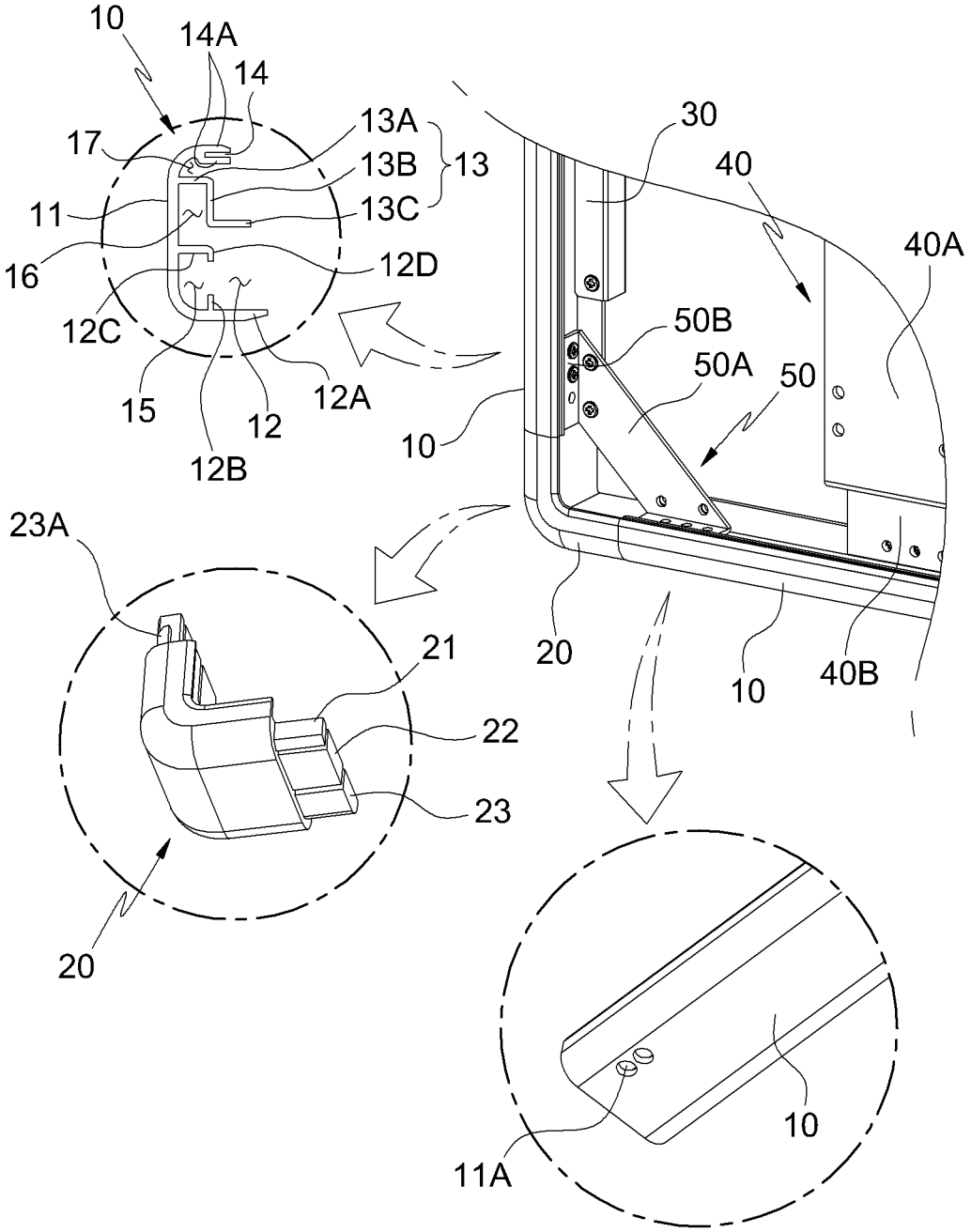
FIG. 4 is a perspective view showing critical portions of the frame assembly according to the present invention.

Only with regard to a frame 10 and elements related to this, direction reference of up, down, left and right is defined based on a sectional view shown in a circle designated by the alternated long and short dash line at upper and left portion of FIG. 4.

In the description of the frame assembly for display panels, although a display or monitor which is installed in a bus will be described as a representative example for the sake of description, the present invention can also be applied to various kinds of billboards or monitors, such as an electronic display, a sign, etc. installed on a building and is not limited to the display or monitor proposed in the following description.

Hereinafter, a frame assembly A for a display panel according to a preferred embodiment of the present invention will be described in detail with reference to the attached drawings.

Figure 1B:
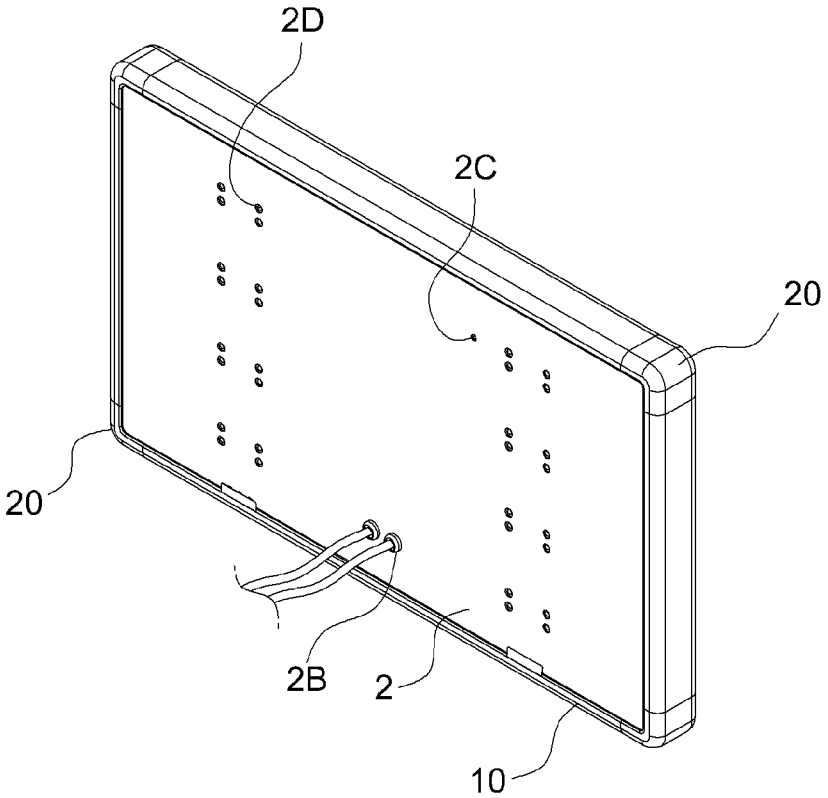

As shown in an assembled front perspective view of FIG. 1A and an assembled rear perspective view of FIG. 1B, a frame assembly A for a display panel according to the present invention includes a display panel 1, a rear cover 2 and a housing 3 which encloses the display panel 1 and the rear cover 2.

Furthermore, the frame assembly A according to the present invention further includes an assembling means for making the coupling among the display panel 1, the rear cover 2 and the housing 3 reliable.

The display panel 1 may be a display device such as an LCD (liquid crystal display), OLED (organic light-emitting diode), etc. which displays dynamic or static images.

Alternatively, the display panel 1 may be a static display device which includes a film having specific patterns or characters, a guide plate and a light source.

The frame assembly A which protects such a display panel and makes it possible to install the display panel indoors or outdoors is used for an electronic display or monitor for indoor or outdoor advertisement, or a signboard or a monitor which is installed in a large vehicle such as a bus or the like in order to provide various kinds of information and images.

The display panel 1 includes a display surface for information delivery on an outer surface thereof, that is, on a front surface thereof. A PCB (1A; refer to FIG. 3) for control of the display surface and supply of power, and an electric wiring for electric connection of the PCB are provided on an inner surface, that is, a rear surface of the display panel 1.

The rear cover 2 embodies a closed structure of the assembly according to the present invention and can be used as an installation means for coupling a separate installation bracket (not shown) or the like to the display device.

The rear cover 2 is made of metal such as stainless steel, aluminum, etc., an alloy such as a galvanized iron sheet, or synthetic resin.

The housing 3 includes a plurality of frames 10 which enclose the display panel 1 and the rear cover 2 and each of which has a sidewall 11, and connection members 20 which connect to the frames 10 to each other.

Typically, the inner surface of the display panel 1, that is, one surface of the display panel 1, to which the PCB (1A; refer to FIG. 3) and electric and electronic wirings are connected, is easily damaged by an external factor, for example, making contact with a person. Particularly, in the case of a billboard which is installed in a bus and is easily exposed to hands of users, it is easily damaged because of carelessness of users or vibrations generated during the operation of the bus. Given this, the housing 3 along with the rear cover 2 provides a structure for covering side and rear surfaces to protect the display panel.

The connection member 20 is made of soft material such as synthetic resin, silicone, other elastomer materials so that when the frame 10 and the assembling means 4 are coupled to each other, the assembly can be facilitated by characteristics of fine contraction and elasticity.

Although there have been various conventional techniques for embodying a closed structure to prevent damage resulting from exposure, these conventional techniques are problematic in that it is difficult to manufacture, the production cost is comparatively expensive, or the assembly process is very complex.

In an effort to overcome the above-mentioned conventional problems, the present invention is provided with the assembling means 4 which is coupled to the housing, particularly, the frames 10, to embody the closed structure, and makes the coupling among the display panel 1, the rear cover 2 and the housing more reliable.

Figure 2:
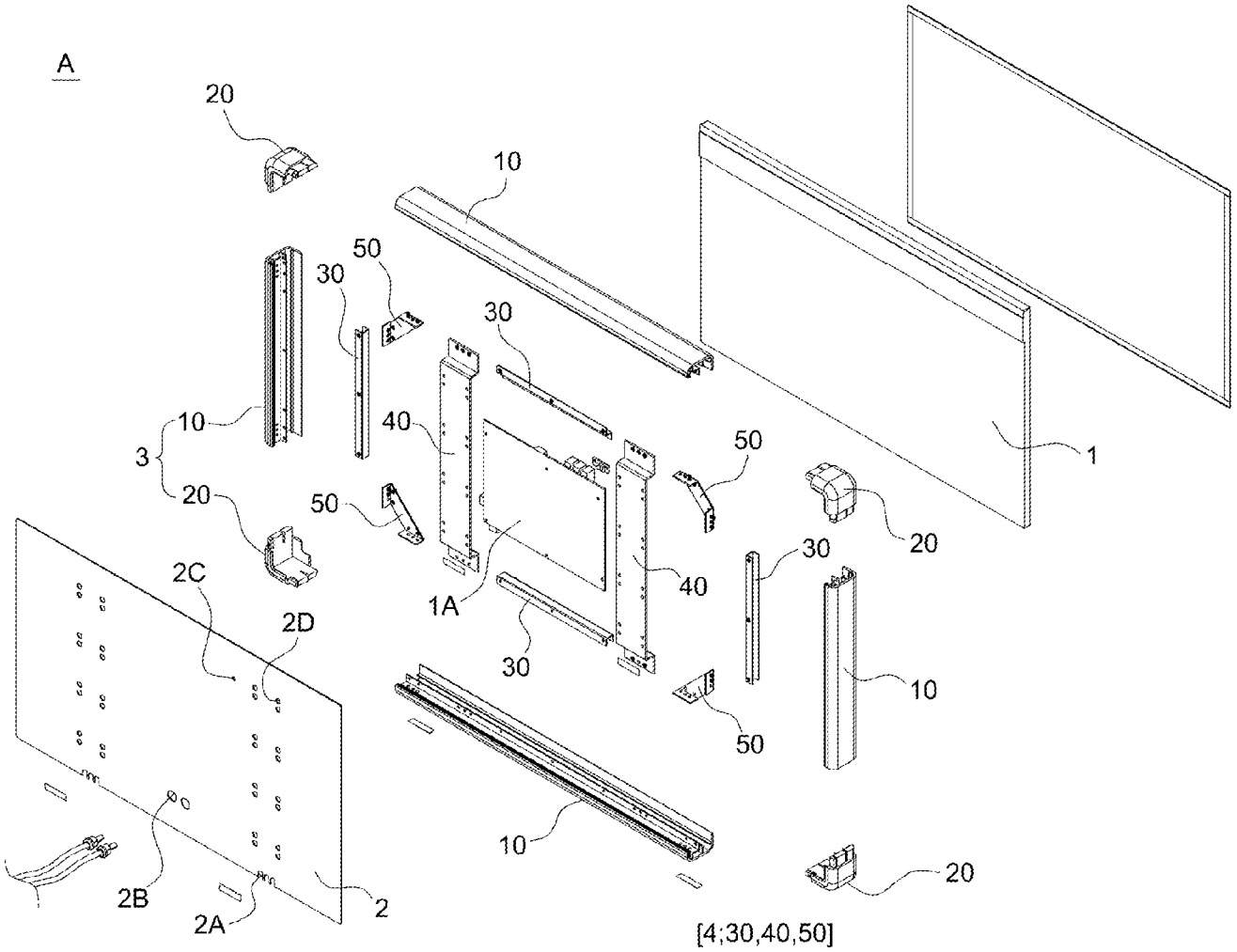
FIG. 2 is an exploded perspective view of the frame assembly according to the present invention.
Figure 3:
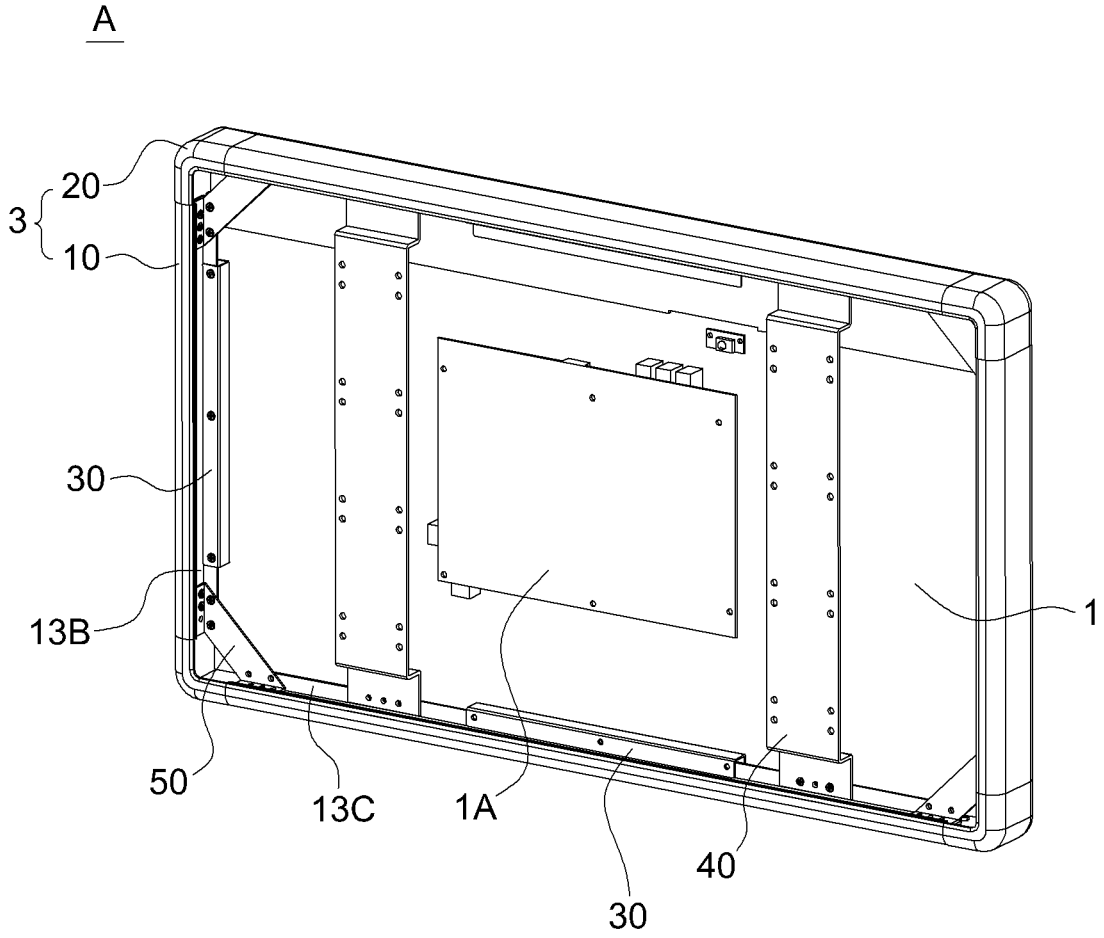
FIG. 3 is a perspective view showing the frame assembly from which a rear cover has been removed according to the present invention.

As shown in the exploded perspective view of FIG. 2 and the rear perspective view of FIG. 3 from which the rear cover 2 has been removed, the assembling means 4 includes fastening brackets 30 which pressurize and fasten the display panel 1 to the frames 10 of the housing 3, support brackets 40 which support the rear cover 2, and auxiliary brackets 50 which assist the coupling between corresponding adjacent frames 10.

Prior to the explanation of the assembly of the display device and the realization of the closed structure using the assembling means 4, detailed constructions of the frames 10 and the connection members 20 will be explained in detail below.

As shown in FIGS. 1 through 4, the frames 10 according to the present invention are respectively coupled to upper, lower, left and right sides of the display panel 1, particularly, having a rectangular shape.

In detail, as can be understood from the enlarged sectional view shown in a circle designated by the alternated long and short dash line at the upper and left portion of FIG. 4, each frame 10 has a mounting space 12 into which upper, lower, left or right edge of the display panel 1 is coupled, a connection piece 13 to which the corresponding fastening bracket 30, the corresponding support bracket 40 and the corresponding auxiliary bracket 50 are coupled, and an insert slot 14 into which the corresponding connection member 20 is inserted.

Furthermore, the mounting space 12 is formed above a support protrusion 12A which is bent inwards from the sidewall 11.

In detail, the support protrusion 12A is bent inwards from a lower end of the sidewall 11 and extends a predetermined length.

Furthermore, an alignment protrusion 12C which protrudes inwards from the sidewall 11 is provided above the support protrusion 12A.

The connection piece 13 protrudes inwards from the sidewall 11 and is disposed above the alignment protrusion 12C.

The mounting space 12 for receiving the peripheral edge of the display panel 1 is defined among an upper surface of the support protrusion 12A, a right end of the alignment protrusion 12C and a lower surface of the support part 13C that is an end of the connection piece 13.

A restriction protrusion 12B protrudes upwards from the support protrusion 12A at a position spaced apart from the sidewall 11 by a predetermined distance so as to more reliably and closely receive the display panel 1 in the mounting space 12.

A guide protrusion 12D is formed by bending an end of the alignment protrusion 12C downwards.

As can be appreciated from the enlarged perspective view of the connection member 20 designated by the alternated long and short dash line at the lower and left portion of FIG. 4, a first coupling protrusion 21 of the connection member 20 is coupled into a first space 15 which is defined among an inner surface of the lower end of the sidewall 11, the alignment protrusion 12C, the guide protrusion 12D, the support protrusion 12A and restriction protrusion 12B.

As shown in FIG. 3, the display panel 1 is mounted to the mounting spaces 12. Each fastening bracket 30 is coupled to the corresponding connection piece (13; refer to FIG. 4) of the frame 10 and can be fixed thereto by applying pressure to the display panel 1 forwards (downwards based on the frame 10 of the enlarged sectional view shown in a circled designated by the alternated long and short dash line at upper and left portion of FIG. 4).

For this, the connection piece 13 of the frame 10 includes a connection part 13A which is disposed above the mounting space 12 (in more detail, above the alignment protrusion 12C) and connected to the sidewall 11, a bent part 13B which is bent downwards from the connection part 13A, and the support part 13C which is bent inwards from the bent part 13B.

As shown in FIGS. 2 and 3, each fastening bracket 30 has a '⊏'-shaped cross-section, and each of the bent ends thereof is coupled to the corresponding frame 10, particularly, the corresponding one of the frames 10 coupled to the left and right edge of the display panel 1.

In detail, the bent end of the fastening bracket 30 is coupled, by means of a bolt, to a central portion of an upper surface of the support part 13C which is provided parallel to the mounting space 12.

Thereby, pressure is applied to the rear surface of the display panel 1. As a result, the front surface of the display panel 1 comes into close contact with the upper surface of the support protrusion 12A which forms the mounting space 12.

The support brackets 40 connect the frames 10, which are coupled to the upper and lower edges of the display panel 1, to each other. As needed, the support brackets 40 may be configured to connect the left and right frames 10 to each other.

In detail, the support brackets 40 are coupled to the corresponding support parts 13*c* of the frames 10 and support the rear cover 2 which protects the rear surface of the display panel 1.

As shown in FIG. 4, the auxiliary brackets 50 are diagonally coupled to ends of the frames 10 to connect the upper and lower frames to the left and right frames. Thereby, the frames 10 that are coupled to the connection members 20 can be reliably prevented from being moved upwards, downwards, leftwards or rightwards or being separated from each other.

In detail, each of the wing parts 50B provided on opposite ends of the auxiliary bracket 50 and each of the opposite ends of a body part 50A of the auxiliary bracket 50 are respectively coupled by means of bolts to the bent part 13B and the support part 13C of the connection piece 13 at the end of the corresponding one of the frames 10 which are respectively coupled to the four edges of the display panel 1.

Two bifurcating protrusions 14A spaced apart from each other are provided above the connection piece 13 on the upper end of the sidewall 11 and are bent inwards. The insert slot 14 is defined between the bifurcating protrusions 14A. The rear cover 2 is inserted into the insert slot 14 to protect the rear surface of the display panel 1.

The coupling structure of the frames 10 and the connection members 20 that constitute the housing 3 will be explained with reference to FIG. 4.

The mounting space 12 of the frame 10 and the space defined between the connection piece 13 and the insert slot 14 function as a connection means for the connection member 20.

The first space 15 is defined between the sidewall 11 and the mounting space 12 of the frame 10, in detail, among the sidewall 11, the restriction protrusion 12B and the alignment protrusion 12C. The first coupling protrusion 21 of the connection member 20 is inserted into the first space 15.

The guide protrusion 12D that is bent downwards from the end of the alignment protrusion 12C forms the mounting space 12 into which the display panel 1 is inserted. Further, the guide protrusion 12D blocks a portion of an opening of the first space 15 and guides the first coupling protrusion 21 of the connection member 20 that is inserted into the first space 15. Also the guide protrusion 12D functions to prevent the first coupling protrusion 21 from being undesirably removed from the first space 15.

Furthermore, a second space 16 is formed between the alignment protrusion 12C and the connection piece 13. The connection member 20 includes a second coupling protrusion 22 which is coupled into the second space 16 and is spaced apart from the first coupling protrusion.

The bent part 13B of the connection piece 13 of the frame 10 also functions as a guide and removal prevention means for the second coupling protrusion 22, in the same manner as that of the guide protrusion 12D.

A third space 17 is formed between the connection part 13A of the connection piece 13 of the frame 10 and the bifurcating protrusions 14A which define the insert slot 14 therebetween. The connection member 20 further includes a third coupling protrusion 23 which is coupled into the third space 17 and is spaced apart from the second coupling protrusion.

Preferably, the first, second and third coupling protrusions 21, 22 and 23 are respectively inserted into the first, second and third spaces 15, 16 and 17 in a tight fitting manner.

As such, the connection members 20 that are made of soft material such as synthetic resin, silicone, or other elastomer materials are disposed at corners of a signboard, billboard or monitor which is installed at a location that is prone to making contact with people. Thus, the connection members 20 prevent people from being injured by the corners.

Furthermore, when the frames 10 and the assembling means 4 are coupled to each other, fine contractility or elasticity of the connection members 20 enhances the assemblability.

Also, the connection members 20 function to protect the display panel 1 from impact applied to the corners of the display panel 1, the frames 10 or the rear cover 2.

The first, second and third coupling protrusions 21, 22 and 23 which are configured to be separated from each other improve such contractility, elasticity and shock absorption ability.

If each end of the soft connection member 20 merely has a single integrated structure, the connection member 20 may be easily undesirably separated from the frame.

However, as shown in the drawings, in the present invention, each end of the soft connection member 20 includes the coupling protrusions 21, 22 and 23 which are respectively inserted into the spaces 15, 16 and 17 of the frame 10 made of hard material.

In this case, the soft connection member 20 that is coupled to the end of the frame is not easily removed therefrom. As such, the coupling force between the frame 10 and the connection member 20 can also be enhanced.

Moreover, an elastic coupling member 23A protrudes upwards from the third coupling protrusion 23 of the connection member so as to further enhance the coupling force between the frame 10 and the connection member 20.

The third space 17 is formed by bending the upper end of the sidewall 11 that has the insert slot 14 therein. In consideration of convenience of manufacture and the characteristics of the material, the third space 17 is formed to be rounded and is small compared to the first space 15. Therefore, when the third coupling protrusion 23 is inserted into the third space 17, a small gap is easily formed. Give this, it is preferable that the third coupling protrusion 23 have the elastic coupling member 23A which can fill such a gap and enhance the coupling force.

Preferably, the elastic coupling member 23A is made of the same material as that of the connection member 20 and is integrally formed with the connection member 20. In consideration of error in the manufacture of the frame 10, the elastic coupling member 23A has a larger cross-sectional area than that of the third space 17. The elastic coupling member 23A is configured such that it can be assembled with the corresponding element after a worker cuts off a portion of the cross-section of the elastic coupling member 23A.

As stated above, in the present invention, the mounting spaces 12, the connection pieces 13 and the insert slots 14 of the frames 10 that constitute the housing 3 function to couple the elements of the assembly A to the assembling means 4.

Furthermore, the mounting spaces 12, the connection pieces 13 and the insert slots 14 function as a means for coupling the connection members 20 to the frames 10, thus making the coupling of the connection members 20 to the frames 10 reliable.

The protrusions 12A, 12B, 12C, 12D, 13A, 13B, 13C and 14A which are connected to the sidewall 11 to form the mounting space 12 of the frame 10, the connection piece 13 and the insert slot 14 can also prevent moisture or water from entering the display panel through the edges of the display panel when a person spills beverages or water onto the display panel as a result of carelessness or the display panel is exposed to the outside, that is, to rain or snow.

Furthermore, the casing (the assembly of the housing 3, the assembling means 4 and the rear cover 2) for the display panel 1 that includes the frames 10, the connection members 20, the fastening brackets 30, the support brackets 40, the auxiliary brackets 50 and the rear cover 2 has a simple structure, is formed with a minimized number of parts, and can be easily assembled. In addition, even if the size of the display panel 1 is changed, the casing for the display panel 1 can be compatibly used.

Therefore, the display panel according to the present invention can be used as signboards, billboards, monitors, etc. for various purposes and in various categories. Further, the display panel according to the present invention can be markedly improved in competitiveness in the production cost that is a very critical factor related to profitability and market competitive power.

Furthermore, the present invention has high stability and shock resistance in the assembled state and can also provide slight waterproof characteristics.

The frames 10 is made of metal such as stainless steel, aluminum, alloy materials, other synthetic resin materials such that it can be prevented from being easily damaged by external shock.

The frames 10 and the casing (the assembly of the housing 3, the assembling means 4 and the rear cover 2) are manufactured by extruding, rolling, injection molding, pressing, etc. and then treated by postprocessing, e.g. drilling.

Next, the coupling structure of the elements 30, 40 and 50 constituting the assembling means 4 for forming the closed structure of the frame assembly and making the coupling reliable will be described in more detail.

Each auxiliary bracket 50 assists the coupling between the corresponding adjacent frames 10, thus increasing the coupling force. The auxiliary bracket 50 includes the body part 50A and the wing parts 50B which are respectively formed by bending the opposite ends of the body part 50A.

Preferably, each wing part 50B is bent from the body part 50A such that the wing part 50B comes into surface contact with the bent part 13B of the connection piece 13 of the corresponding frame 10.

Coupling holes which overlap each other are respectively formed in the bent part 13B of the connection piece 13 and the wing part 50B of the auxiliary bracket 50. A fastening means (particularly, a bolt) is tightened into the coupling holes so that the auxiliary bracket 50 can be reliably coupled to the corresponding end of the frame 10.

Furthermore, coupling holes which overlap each other are respectively formed in the body part 50A of the auxiliary bracket 50 and the support part 13C of the connection piece 13. A fastening means (particularly, a bolt) is also tightened into the coupling holes so that the coupling force between the adjacent frames can be further enhanced.

Preferably, a tool insert hole 11A (for a screwdriver or wrench) which is illustrated in an enlarged perspective view shown in a circle designated by the alternated long and short dash line at the right and lower portion of FIG. 4 is further formed in the sidewall 11 at a position adjacent to each end of the frame 10.

By virtue of the tool insert hole 11A, it is possible to couple each wing part 50B of the auxiliary bracket 50 to the corresponding bent part 13B of the connection piece 13 using a tool even from the outside of the corresponding frame 10.

The tool insert hole 11A is formed at a position corresponding to the coupling holes formed in the wing part 50B and the corresponding bent part 13B. Preferably, the size of the tool insert hole 11A is slightly larger than that of the coupling holes so as to facilitate the work of tightening a bolt using the tool.

As can be understood from FIGS. 2 through 4, each support bracket 40 includes a contact support part 40A which comes into contact with the rear cover 2 and supports it so as to prevent the rear cover 2 from being curved inwards, and supports coupling parts 40B which are respectively bent from opposite ends of the contact support part 40A and are coupled to the support parts 13C of the connection pieces 13 of the corresponding frames 10.

Coupling holes which overlap each other are respectively formed in the support coupling part 40B and the support part 13C so that the support bracket 40 can be coupled to the corresponding frames 10 by fastening members (or fastening means, particularly, bolts) which are tightened into the coupling holes.

As shown in FIG. 2, tool insert notches 2A through which a tool is inserted for the fastening members 42 are formed in one edge of the rear cover 2, particularly, in opposite sides of the lower edge of the rear cover 2. In this embodiment, two groups each of which includes three tool insert notches 2A are respectively formed at the left and right sides of the lower edge of the rear cover 2.

The tree frames 10 are respectively coupled to the upper, left and right edges of the display panel 1. The connection members 20 are respectively coupled to both upper corners of the display panel 1 between the frames 10.

The fastening brackets 30 are coupled to the respective left and right frames 10.

The two auxiliary brackets 50 are coupled to the respective junctions being the upper frame 10 and the left and right frames 10.

Thereafter, the two support brackets 40 are disposed such that the upper coupling holes of the support brackets 40 are aligned with the coupling holes of the support part 13*c* of the connection piece 13 of the upper frame 10. The fastening members (or fastening means, particularly, bolts) are tightened into the coupling holes.

Subsequently, the upper wing parts 50B and the upper portions of the body parts 50A of the two lower auxiliary brackets 50 are coupled to the bent parts 13B and the support parts 13C of the connection pieces 13 of the left and right frames 10 by the fastening means.

The rear cover 2 is thereafter inserted into the corresponding insert slots 14 which are defined between the bifurcating protrusions 14A of the frames 10.

The connection members 20 are fitted into the lower ends of the left and right frames 10. The lower frame 10 is coupled to the connection members 20 that are disposed at both ends of the lower edge of the display panel 1.

Alternatively, the two connection members 20 may be first fitted into both ends of the lower frame 10, before this assembly of the lower frame 10 and the two connection members 20 is assembled with the left and right frames 10 in such a way that the upper coupling protrusions 21, 22 and 23 of the connection members 20 are respectively inserted into the spaces 15, 16 and 17 of the left and right frames 10.

Thereafter, through the tool insert notches 2A formed in opposite sides of the lower edge of the rear cover 2, the fastening means is tightened into the coupling holes of the support coupling parts 40B of the support bracket 40 and the coupling holes of the support part 13C of the connection piece 13 of the lower frame 10, thus completing the assembly process.

Furthermore, the coupling of the coupling holes of the lower wing parts 50B of the two lower auxiliary brackets 50 to the bent part 13B of the connection piece 13 of the lower frame is performed through the tool insert holes 11A formed in the sidewall 11 of the lower frame 10.

As needed, tool insert holes or notches may be formed at predetermined positions in the rear cover 2 to make it possible to tighten fastening means, that is, bolts, both into the coupling holes formed in the support part 13C of the connection piece 13 of the lower frame 10 and into the coupling holes formed in the lower portions of the body parts 50A of the two lower auxiliary brackets 50.

As such, because the tool insert notches 2A are formed in the rear cover 2, even after the assembly of the rear cover 2 is completed, the work of coupling the frames 10 to the support brackets 40 which are disposed at a closed area in the housing 3 is possible. Therefore, work convenience and assemblability can be enhanced.

Furthermore, the support part 13C of each connection piece 13 and the corresponding fastening bracket 30 have coupling holes which overlap each other. A single fastening member or fastening means, particularly, a bolt, is tightened into these coupling holes to couple the support part 13C to the fastening bracket 30.

The fastening member preferably comprises a bolt or screw to reliably fasten the coupling holes to each other. Although it is not shown in the drawings, as necessary, a nut or the like may also be used.

The coupling holes and the fastening members may be variously changed in number and size depending on selection of a production company. More preferably, for convenience of production, the coupling holes and the fastening members are manufactured to have the same size.

Furthermore, the frame assembly according to the present invention preferably further includes sealing members which cover the tool insert holes 11A and the tool insert notches 2A, thus providing a more reliably closed structure.

Each sealing member comprises an elastic stopper made of synthetic resin, adhesive tape or a sealing plate made of the same material as that of the frame 10. The sealing member is preferably attached to the corresponding part by a bonding method or the like.

In this embodiment, as shown in FIGS. 1 and 2, sealing plates are used as the sealing members.

As shown in FIG. 2, the rear cover 2 further has an electric wire hole 2B through which internal electric wires lead to the outside, and a reception hole 2C which is provided for a power switch, a remote controller or the like. The electric wiring hole 2B and the reception hole 2C are covered with flexible covering members made of waterproof material so as to prevent damage of related elements because of vibrations or shock.

The rear cover 2 further includes a mounting hole 2D through which a mounting bracket (not shown) for installation of the frame assembly is coupled to the rear cover 2.

That is, the mounting bracket is coupled to the rear cover through the mounting hole 2D, and the worker can easily install the frame assembly according to the present invention on a wall of a building, a bus, etc. using the mounting bracket.

The single mounting hole 2D may be formed in the rear cover 2. As needed, a plurality of mounting holes 2D may be provided. Each support bracket 40 has a mounting hole which corresponds to the mounting hole 2D of the rear cover 2. Thus, the support brackets 40 function not only as an internal means for supporting the rear cover 2 but also as a means for dispersing the load concentrated on the rear cover 2 when the mounting bracket is coupled to the rear cover 2, thus making the installation of the frame assembly more reliable, and preventing the frame assembly from being undesirably displaced from the original installation location.

The mounting hole 2D may be covered by the mounting bracket that is mounted to the rear cover 2, or by a separate sealing member. The number of mounting holes 2D may also be adjusted. In these ways, the closed structure of the present invention for preventing the internal elements from being damaged by external factors can be secured.

Hereinafter, the assembly process of the frame assembly A according to the present invention will be described in detail along with explanation of the coupling relationship and coupling method of the assembling means 4.

In the following description, although the frame assembly that has a rectangular plate shape as shown in the drawings will be explained as a representative example, those skilled in this art will appreciate that various modifications, additions and substitutions are possible. Therefore, the bounds of the present invention must not be limited to the following description.

The two connection members 20 are respectively coupled to both ends of the upper frame 10. The left and right frames 10 are respectively coupled to the remaining coupling protrusions of the left and right frames 10, thus forming a sub-assembly that has an opening on one side thereof.

Therefore, the display panel 1 is coupled to the sub-assembly in a sliding manner. Therefore, the rear bent parts of the fastening brackets 30, each of which has a '⊏' shape, are respectively coupled to the support parts 13*c* of the connection pieces 13 of the left and right frames 10 so that the front bent parts of the fastening bracket press the display panel 1 towards the front surfaces of the frames 10, that is, towards the support protrusions 12A of the frames 10 and thus support the display panel 1.

Thereby, the bezel of the display panel 1 that is coupled to the housing, in other words, the frames 10, can be minimized so that the available screen area of the display panel 1 can become as large as possible.

As a result, the entire size of a typical monitor or signboard which is installed in a building, a bus, etc. becomes similar to the size of the display panel 1, whereby installation space restriction can be reduced.

Thereafter, the support brackets 40 are assembled with the frame 10 that faces the opening, particularly, at positions adjacent to the junctions between the upper frame 10 and the left and right frames 10.

In this state, because the rear cover 2 is not still assembled, the worker can easily couple the elements to each other using a tool such as a screwdriver.

Subsequently, the upper parts of the left and right auxiliary brackets 50 which are disposed at the lower position are respectively assembled with the lower ends of the left and right frames 10.

The assembly of the lower left and right auxiliary brackets 50 can also be easily conducted because the rear cover 2 is provided. The assembly of the support brackets 40 and the assembly of the auxiliary brackets 50 may be changed in the order or be conducted at the same time.

After the upper coupling holes of the two support brackets 40 are aligned with the coupling holes of the support part 13C of the connection piece 13 of the upper frame 10, fastening members (or fastening means, particularly, bolts) are tightened into the coupling holes.

With the exception of the assembly of the rear cover, the lower frame 10, and the lower portions of the wing parts and the body parts of the lower left and right auxiliary brackets 50, after the assembly of the remaining assembling means 4 is completed, the worker inserts the rear cover 2 into the insert slots 14 of the left and right frames 10 through the opening of the sub-assembly, that is, through the open lower part of the sub-assembly.

After the assembly of the rear cover 2 with the frames 10 is completed, the lower frame is coupled to the opening of the sub-assembly.

Prior to this, the connection members 20 are inserted to the lower ends of the left and right frames 10, and then the lower frame 10 is coupled to the lower connection members 20. Here, thanks to the elastic characteristics of the connection members 20, the lower frame 10 can be coupled to the lower connection members 20 even after the assembly of the lower connection members 20 with the left and right frames 10 has been completed.

Alternatively, after the two lower connection members 20 are respectively fitted into both ends of the lower frame 10, the lower frame 10 may be assembly with the sub-assembly 10 and 20 in such a way that the upper coupling protrusions 21, 22 and 23 of the lower connection members 20 are respectively fitted into the spaces 15, 16 and 17 of the left and right frames 10.

At this step, the display panel 1 and the rear cover 2 are respectively inserted into the mounting space 12 and the insert slot 14 of the lower frame 10.

As needed, the worker may couple the lower frame 10 (or depending on an assembly order, the upper, left or right frame 10, in other words, the frame 10 to be lastly assembled) to the sub-assembly in a tight fitting manner, after the corresponding connection members 20 have been coupled to both ends of the lower frame 10.

In the frame assembly according to the present invention, among the frames 10 which are assembled with each other, the tool insert hole 11A is formed in the frame 10 to be lastly assembled, in this embodiment, in the lower frame 10, thus making it possible for the worker to easily conduct the work of tightening the fastening members in the housing. In addition, the exposure of the fastening members to the outside can be minimized, thereby preventing a problem of the frame assembly being reduced in the coupling force or of the fastening members being damaged.

In other words, the tool insert hole 10A is formed in the frame 10 to be assembled at the last assembly step. Therefore, after the assembly of the frames 10 has been completed, the worker can tighten, using a tool, the fastening members into the coupling holes of the bent parts 13B of the frame 10 and the auxiliary brackets 50 which are installed in the housing.

Furthermore, in the present invention, the fastening members are not exposed outside the housing so that the fastening members can be prevented from being damaged.

In addition, the tool insert notches 2A are formed in the edge of the rear cover 2 that is adjacent to the opening of the sub-assembly. Therefore, the worker can easily use the tool to tighten the fastening members 42 into the coupling holes of the support brackets and the support part 13C of the frame 10.

As such, the worker can easily perform the work of assembling the frame assembly for the display panel that has the closed structure.

Furthermore, the frame assembly according to the present invention is configured such that various kinds of fit worktables can be used, for example, a worktable which can expose the perimeter of the display panel from the worktable can be used so that during the assembly process of the frame assembly A, the worker can easily assemble the frames to the upper, lower, left and right edges of the display panel while the screen of the display panel 1 faces downwards. In this case, the worker can conduct the assembly process in a consecutive order without having to lift or move the sub-assembly. Therefore, with regard to the frame assembly which is assembled with a large display panel, only a single worker or a few of workers are required for the assembly work. Thus, economic feasibility and work efficiency can be markedly enhanced.

The sealing members are bonded to the tool insert holes 10A and the tool insert notches 2A so that the frame assembly can have a more reliable closed structure. Furthermore, the elements provided for securing the coupling force can be prevented from being exposed to the outside, whereby the appearance of the frame assembly can be prevented from deteriorating, and the design of the frame assembly can become simple.

As described above, in a frame assembly for a display panel according to the present invention, a fastening bracket, a support bracket and an auxiliary bracket are provided in a housing not only to embody a closed structure of the housing that encloses the display panel and a rear cover but also to make the coupling between the elements reliable, thus enhancing the durability.

Furthermore, in the frame assembly according to the present invention, frames have a simple structure so that elements can be coupled to the frames in a simple coupling manner, for example, in a sliding coupling manner. Thereby, only a few of workers are required to conduct the work of assembling the frame assembly. In other words, the workability can be markedly enhanced.

In addition, the frame assembly according to the present invention has a tool insert hole and a tool insert notch through which a tool can be inserted into the frame assembly, thus making internal coupling of an assembling means possible even after the frame assembly process has been completed. Thereby, work convenience can be enhanced.

Although a frame assembly for a display panel according to a preferred embodiment of the present invention has been disclosed for illustrative purposes, those skilled in the art will appreciate that various modifications, additions and substitutions are possible, without departing from the scope and spirit of the invention as disclosed in the accompanying claims.

What is claimed is:

1. A frame assembly for a display panel, comprising:

a display panel;

a rear cover;

a housing comprising: a plurality of frames enclosing the display panel and the rear cover, each of frames having a sidewall; and a connection member connecting the frames to each other; and assembling means installed in the housing to provide a closed structure, the assembling means provided to ensure coupling force among the display panel, the rear cover and the housing, wherein the assembling means comprises:

a fastening bracket pressing the display panel onto the frames of the housing and fastening the display panel to the frames;

a support bracket supporting the rear cover; and an auxiliary bracket assisting connection between the adjacent frames, and wherein each of the frames has: the sidewall; a mounting space formed by a support protrusion bent inwards from a lower end of the sidewall; a connection piece disposed above the mounting space, the connection piece comprising a connection part connected to the sidewall, a bent part bent downwards from the connection part, and a support part bent inwards from the bent part, the support bracket being coupled to the support part; and an insert slot formed between two bifurcating protrusions that are disposed above the connection piece and are bent inwards from an upper end of the sidewall, the rear cover being inserted into the insert slot in a sliding manner.

2. The frame assembly as set forth in claim 1, wherein a tool insert hole is formed in the sidewall of each of the frames so that a tool can be inserted into the housing through the tool insert hole to couple the auxiliary bracket of the assembling means to the bent part of the connection piece.

3. The frame assembly as set forth in claim 1, wherein a tool insert notch is formed at a predetermined position in the rear cover so that a tool can be inserted into the rear cover through the tool insert notch to couple the support bracket of the assembling means to the support part of the connection piece.

* * * * *